US007203323B2

(12) United States Patent
Tashev

(10) Patent No.: US 7,203,323 B2
(45) Date of Patent: Apr. 10, 2007

(54) SYSTEM AND PROCESS FOR CALIBRATING A MICROPHONE ARRAY

(75) Inventor: Ivan Tashev, Kirkland, WA (US)

(73) Assignee: Microsoft Corporation, Redmond, WA (US)

( * ) Notice: Subject to any disclaimer, the term of this patent is extended or adjusted under 35 U.S.C. 154(b) by 845 days.

(21) Appl. No.: 10/627,048

(22) Filed: Jul. 25, 2003

(65) Prior Publication Data

US 2005/0018861 A1 Jan. 27, 2005

(51) Int. Cl.
*H04R 3/00* (2006.01)

(52) U.S. Cl. ..... 381/92

(58) Field of Classification Search ..... 381/92; 348/14.01, 14.08; 379/202.01, 206.01
See application file for complete search history.

(56) References Cited

U.S. PATENT DOCUMENTS 5,515,445 A * 5/1996 Baumhauer et al. ..... 381/92
7,088,831 B2 * 8/2006 Rosca et al. ..... 381/92
2002/0150263 A1 * 10/2002 Rajan ..... 381/92

OTHER PUBLICATIONS

Feder, M., and E. Weinstenin, Parameter estimation of superimposed signals system using EM algorithm, *IEEE Trans. Acoustic, Speech and Sig. Proc.*, vol. ASSP-36, 1988, pp. 477-490.

Nordholm, S., I. Claesson, M. Dahl, Adaptive microphone array employing calibration signals. An analytical evaluation, *IEEE Trans. on Speech and Audio Processing*, vol. 7 No. 3, May 1999, pp. 241-252.

Seltzer, M., B. Raj, Calibration of microphone arrays for improved speech recognition, *Mitsubishi Research Laboratories*, TR-2002-43, Dec. 2001.

Teutsch, H., and G. Elko, An adaptive close-talking microphone array, *IEEE Workshop on Applications of Signal Processing to Audio Acoustics*, New York, 2001.

Wu, H., Y. Jia, Z. Bao, Direction finding and array calibration based on maximal set of nonredundant cumulants, *Proceedings of ICASSP '96*.

* cited by examiner

*Primary Examiner*—Brian T. Pendleton
(74) *Attorney, Agent, or Firm*—Lyon & Harr, LLP; Richard T. Lyon

(57) ABSTRACT

A system and process for self calibrating a plurality of audio sensors of a microphone array on a continuous basis, while the array is in operation, is presented. In essence, the present microphone array self calibration system and process finds a set of corrective gains that provides the best channel matching amongst the audio sensors of the array by compensating for the differences in the sensor parameters. The present system and process is not CPU use intensive and is capable of providing real-time microphone array self-calibration. It is based on a simplified channel model, projection of sensor coordinates on the direction of arrival (DOA) line, and approximation of received energy levels, all of which speed up processing time.

31 Claims, 3 Drawing Sheets

SYSTEM AND PROCESS FOR CALIBRATING A MICROPHONE ARRAY

BACKGROUND

1. Technical Field

The invention is related to the calibration of microphone arrays, and more particularly to a system and process for self calibrating a plurality of audio sensors of a microphone array on a continuous basis, while the array is in operation.

2. Background Art

With the burgeoning development of sound recognition software and real-time collaboration and communication programs, the ability to capture high quality sound is becoming more and more important. Using a close-up microphone, such as those installed on a headset, is not very convenient. In addition, hands free sound capture with a single microphone is difficult due to interference with reflected sound waves. In some cases frequencies are enhanced and in others frequencies can be completely suppressed. One emerging technology used to effectively capture high quality sound is the microphone array. A microphone array is made up of a set of microphones positioned closely together, typically in a pattern such as a line or circle. The audio signals are captured synchronously and processed together in such an array.

Localization of sound sources plays important role in many audio systems having microphone arrays. For example, finding the direction to a sound source is used for speaker tracking and post processing of recorded audio signals. In the context of a videoconferencing system, speaker tracking is often used to direct a video camera toward the person speaking. Different techniques have been developed to perform this sound source localization (SSL). Many of these techniques are based on beamsteering.

The beamsteering approach is founded on well known procedures used to capture sound with microphone arrays—namely beamforming. In general, beamforming is the ability to make the microphone array "listen" to a given direction and to suppress the sounds coming from other directions. Processes for sound source localization with beamsteering form a searching beam and scan the work space by moving the direction the searching beam points to. The energy of the signal, coming from each direction, is calculated. The decision as to what direction the sound source resides is based on the direction exhibiting the maximal energy. This approach leads to finding extremum of a surface in the coordinate system direction, elevation, and energy.

However, in many cases microphone arrays used for beamforming or sound source localization do not provide the estimated shape of the beam, noise suppression or localization precision. One of the reasons for this is the difference in the signal paths that is caused by differing sensitivity characteristics among the microphones and/or microphone preamplifiers that make up the array. Still further, existing beamsteering and beamforming procedures used for processing signals from microphone arrays, assume a channel match. This is problematic as even a basic algorithm as delay-and-sum procedure is sensitive to mismatches in the receiving channels. More sophisticated algorithms for beamforming are even more susceptible and often require very precise matching of the impulse response of the microphone-preamplifier-ADC (analog to digital converter) combination for all channels.

The problem is that without careful calibration a mismatch in the microphone array audio channels is hard to avoid. The reasons for the channel mismatch are mostly attributable to looseness in the manufacturing tolerances associated with microphones—even when they are of the same type. The looseness in the tolerances associated with components used in the microphone array preamplifiers introduces gain and phase errors as well. In addition, microphone and preamplifier parameters depend on external factors as temperature, atmospheric pressure, the power supply, and so on. Thus, the degree to which the channels of a microphone array match can vary as these external factors change.

The calibration of microphones and microphone arrays is well known and well studied. Generally, current calibration procedures can be an expensive and difficult task, particularly for broadband arrays. Examples of some of the existing approaches to calibrate microphones in a microphone array include the following.

In one group of calibration techniques, calibration is done for each microphone separately by comparing it with an etalon microphone in specialized environment: e.g., acoustic tube, standing wave tube, reverberationless sound camera, and so on [3]. This approach is very expensive as it requires manual calibration for each microphone, as well as specialized equipment to accomplish this task. As such, this calibration approach is usually reserved for situations calling for microphones used to take precise acoustic measurements.

Another group of existing calibration methods generally employ calibration signals (e.g., speech, sinusoidal, white noise, acoustic pulses, and chirp signals to name a few) sent from speaker(s) or other sound source(s) having known locations [4]. In reference [7], far field white noise is used to calibrate a microphone array of two microphones, where the filter parameters are calculated using a normalized least-mean-squares (NLMS) algorithm. Other works suggest using optimization methods to find the microphone array parameters. For example, in reference [5] the minimization criterion is the speech recognition error. Generally, the methods of this group require manual calibration after installation of the microphone array and specialized equipment to generate test sounds. Thus, they too can be time consuming and expensive to accomplish. In addition, as these calibration methods are done ahead of time, they will not remain valid in the face of changes in the equipment and environmental conditions during operation.

Yet another group of calibration methods involve building algorithms for beamforming and sound source localization that are robust to channels mismatch, thereby avoiding the need for calibration. However, it has been found that in operation the performance and theory of most of these adaptive schemes hinge on an initial high-precision match in the array channels to provide good starting point for the adaptation process [5]. This demands a careful calibration of the array elements prior to their use.

The last group of methods is the self-calibration algorithms. The general approach is described in [1]: i.e., find the direction of arrival (DOA) of a sound source assuming that the microphone array parameters are correct, use DOA to estimate the microphone array parameters, and iterate until the estimates converge. Different methods attempt to estimate different ones of the microphone array parameter, such as the sensor positions, gains, or phase shifts. In additional, different techniques are employed to perform the estimation, ranging from normalized mean square error minimization to complex matrix methods [2] and high-order statistical parameter estimation methods [6]. In some cases the complexity of the estimation algorithms makes them unsuitable for practical real-time implementation due to the fact that they require an excessive amount of CPU power during the normal operation of the microphone array.

It is noted that in the preceding paragraphs the description refers to various individual publications identified by a numeric designator contained within a pair of brackets. For example, such a reference may be identified by reciting, "reference [1]" or simply "[1]". A listing of references including the publications corresponding to each designator can be found at the end of the Detailed Description section.

SUMMARY

The present invention is directed toward a system and process for self calibrating a microphone array that overcomes the drawbacks of existing calibration schemes. The present system and process is not CPU use intensive and is capable of providing real-time microphone array self-calibration. It is based on a simplified channel model and the projection of sensors coordinates on the direction of arrival (DOA) line, thus reducing the dimensionality of the problem and speeding up the calculations. In this way the calibration can be accomplished in what is effectively real time, i.e., while the audio signals are being processed by the main audio stream processing modules of the overall audio system.

In essence, the goal of the present microphone array self calibration system and process is to find a set of corrective gains that provide the best channel matching amonqst the audio sensors of the array by compensating for the differences in the sensor parameters. More particularly, the system and process involves self calibrating a plurality of audio sensors of a microphone array by inputting a series of substantially contemporaneous audio frame sets extracted from the signals generated by at least two of the array sensors and a direction of arrival (DOA) associated with each frame set. To speed up processing in one embodiment of the invention, an audio frame set is input only if the frames represent audio data exhibiting evidence of a single dominant sound source and knowledge of its DOA.

For each frame set, the energy of each frame in the set is computed. In addition, an approximation function is established that characterizes the relationship between the known locations of the sensors (as projected on a line representing the DOA) and their computed energy values. This function is then used to estimate the energy of each frame. In tested embodiments of the present invention, a straight line function was employed with success as the approximation function. Next, for each frame in the set under consideration, an estimated gain is computed that compensates for the difference between the computed energy of the frame and its estimated energy. Once a gain has been computed for a frame of the set currently under consideration, it can be normalized prior to applying it to the frame. More particularly, each gain can be normalized by dividing it by the average of all the gain estimates.

The estimated gain represents the aforementioned corrective gain, which when applied to the next frame from the same sensor, compensates for the differences in the array sensors and provides the desired channel matching. Thus, an iteration of the calibration is completed by applying the gain computed for each frame of the set under consideration to the next frame from the associated sensor, prior to processing the frame. The gains are then recomputed for each successive set of frames that are input to maintain the calibration of the array.

The aforementioned action of establishing the approximation function involves projecting the location of each sensor associated with an input frame onto a line defined by the DOA. This reduces the complexity of estimating the energy of each frame to a one dimensional problem. This simplification results in even faster processing times, and so quicker calibration of the array. Given the projected locations of the sensors, establishing the approximation function becomes a matter of finding the function that best characterizes the relationship between the projected locations of the sensors on the DOA line and the computed energy values of the frames associated with the sensors. The type of approximation function employed can be prescribed. For example, the data can be fit to a prescribed parabolic or hyperbolic function, or as in tested embodiments of the present invention, to a straight line function. The resulting function is then used to estimate the energy of each frame. It is noted that the location of the sensors is characterized in terms of a radial coordinate system with the centroid of the microphone array as its origin.

The corrective gains can also be adaptively refined each time a new set of gains is computed. This involves establishing an adaptation parameter that dictates the weight a currently computed gain is given. The refined gain is then computed as the sum of the gain multiplied by the adaptation parameter, and a refined gain computed for the immediately preceding frame input from of the same array channel as the frame used to compute the gain under consideration multiplied by one minus the adaptation parameter. This refining procedure tends to produce gains that are heavily weighted to previously computed gains, thereby reflecting the history of the gain computations, because the adaptation parameter value is chosen to be small. More particularly, in tested embodiments of the present system and process, the adaptation parameter was selected within a range between about 0.001 and 0.01. An adaptation parameter closer to 0.01 would be chosen if calibrating a microphone array operated in a controlled environment where reverberations are minimal. Whereas, an adaptation parameter closer to 0.001 is chosen if calibrating a microphone array operated in an environment where reverberations are not minimal.

The refinement procedure will result in the gain value for each channel of the array eventually converging to a relatively stable value. This being the case, it can be advantageous to suspend the self calibration procedure. More particularly, this can be accomplished by monitoring the value of each refined gain computed for a channel of the array. If the difference between the values of a prescribed number of consecutively computed refined gains, or alternately the values computed over a prescribed period of time, do not exceed a prescribed change threshold, then the inputting of any further frames is suspended. This suspension can be on a channel-by-channel basis, or the suspension can be imposed globally after all the channels do not exceed the prescribed change threshold.

Further, the present self calibration system and process can be configured so that, whenever the inputting of further frames has been suspended for any or all array channels, at least one new audio frame is periodically extracted from the signal generated by the sensor associated with a suspended array channel. It is noted that any frame extracted can be limited to one having audio data exhibiting evidence of a single dominant sound source. It is then determined if the difference between the last, previously-computed refined gain for a suspended channel and the current gain computed for that channel, exceeds the prescribed change threshold. If so, inputting of further frame sets is reinitiated.

The foregoing self calibration system and process has several advantages. For example, as indicated previously the simplification of the channel model and projection of sensors coordinates on the direction of arrival (DOA) line speed up the processing. Additionally, in one embodiment, audio frame sets are input only if the frames represent audio data exhibiting evidence of a single dominant sound source. This also speeds up processing and increases the accuracy of the self calibration. As a result, the calibration can be accomplished in what is effectively real time. Further, the refinement procedure allows the gain values to become stable over time, even in an environment with significant reverberation, and the aforementioned calibration suspension procedure decreases the processing costs of the present system and process even more. Yet another advantage of the present invention is that since the array sensors are not manually calibrated before operational use, changing conditions will not impact the calibration. For example, as microphone and preamplifier parameters depend on external factors as temperature, atmospheric pressure, the power supply, and so on, changes in these factors could invalidate any pre-calibration. Since the present calibration system and process continuously calibrates the microphone array during operation, changes in external factors are compensated for as they change. In addition, since changes in the microphone and preamplifier parameters can be compensated for on the fly by the present system and process, components can be replace without any significant effect. Thus, for example, a microphone can be replaced without replacing the preamplifier or manual recalibration. This is advantageous as significant portion of the cost of a microphone array is its preamplifiers.

In addition to the just described benefits, other advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

1.0 The Computing Environment

Figure 1:
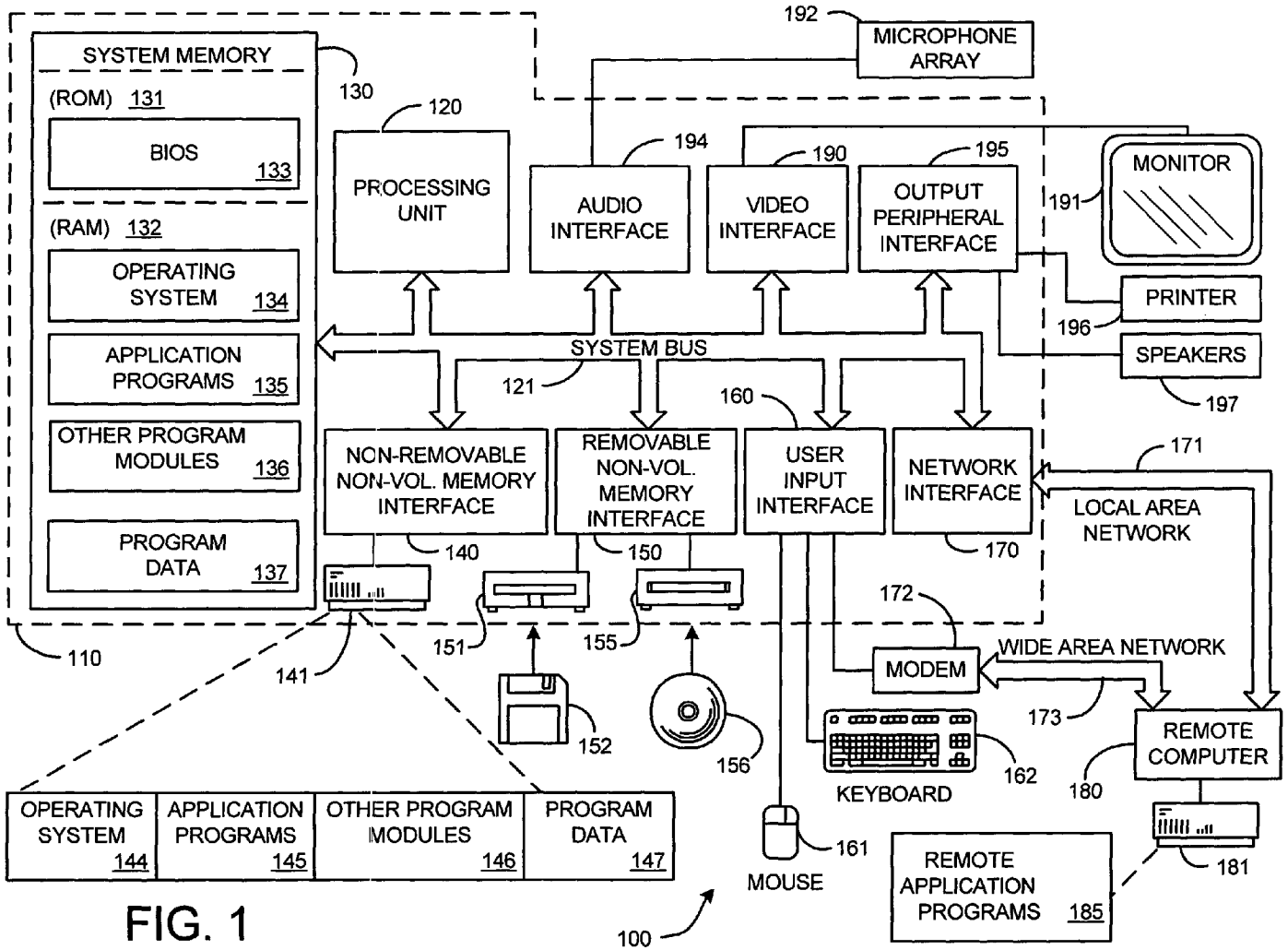
FIG. 1 is a diagram depicting a general purpose computing device constituting an exemplary system for implementing the present invention.

Before providing a description of the preferred embodiments of the present invention, a brief, general description of a suitable computing environment in which the invention may be implemented will be described. FIG. 1 illustrates an example of a suitable computing system environment 100. The computing system environment 100 is only one example of a suitable computing environment and is not intended to suggest any limitation as to the scope of use or functionality of the invention. Neither should the computing environment 100 be interpreted as having any dependency or requirement relating to any one or combination of components illustrated in the exemplary operating environment 100.

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

With reference to FIG. 1, an exemplary system for implementing the invention includes a general purpose computing device in the form of a computer 110. Components of computer 110 may include, but are not limited to, a processing unit 120, a system memory 130, and a system bus 121 that couples various system components including the system memory to the processing unit 120. The system bus 121 may be any of several types of bus structures including a memory bus or memory controller, a peripheral bus, and a local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus also known as Mezzanine bus.

Computer 110 typically includes a variety of computer readable media. Computer readable media can be any available media that can be accessed by computer 110 and includes both volatile and nonvolatile media, removable and non-removable media. By way of example, and not limitation, computer readable media may comprise computer storage media and communication media. Computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 110. Communication media typically embodies computer readable instructions, data structures, program modules or other data in a modulated data signal such as a carrier wave or other transport mechanism and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. Combinations of the any of the above should also be included within the scope of computer readable media.

The system memory 130 includes computer storage media in the form of volatile and/or nonvolatile memory such as read only memory (ROM) 131 and random access memory (RAM) 132. A basic input/output system 133 (BIOS), containing the basic routines that help to transfer information between elements within computer 110, such as during start-up, is typically stored in ROM 131. RAM 132 typically contains data and/or program modules that are immediately accessible to and/or presently being operated on by processing unit 120. By way of example, and not limitation, FIG. 1 illustrates operating system 134, application programs 135, other program modules 136, and program data 137.

The computer 110 may also include other removable/non-removable, volatile/nonvolatile computer storage media. By way of example only, FIG. 1 illustrates a hard disk drive 141 that reads from or writes to non-removable, nonvolatile magnetic media, a magnetic disk drive 151 that reads from or writes to a removable, nonvolatile magnetic disk 152, and an optical disk drive 155 that reads from or writes to a removable, nonvolatile optical disk 156 such as a CD ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The hard disk drive 141 is typically connected to the system bus 121 through an non-removable memory interface such as interface 140, and magnetic disk drive 151 and optical disk drive 155 are typically connected to the system bus 121 by a removable memory interface, such as interface 150.

The drives and their associated computer storage media discussed above and illustrated in FIG. 1, provide storage of computer readable instructions, data structures, program modules and other data for the computer 110. In FIG. 1, for example, hard disk drive 141 is illustrated as storing operating system 144, application programs 145, other program modules 146, and program data 147. Note that these components can either be the same as or different from operating system 134, application programs 135, other program modules 136, and program data 137. Operating system 144, application programs 145, other program modules 146, and program data 147 are given different numbers here to illustrate that, at a minimum, they are different copies. A user may enter commands and information into the computer 110 through input devices such as a keyboard 162 and pointing device 161, commonly referred to as a mouse, trackball or touch pad. Other input devices (not shown) may include a joystick, game pad, satellite dish, scanner, or the like. These and other input devices are often connected to the processing unit 120 through a user input interface 160 that is coupled to the system bus 121, but may be connected by other interface and bus structures, such as a parallel port, game port or a universal serial bus (USB). A monitor 191 or other type of display device is also connected to the system bus 121 via an interface, such as a video interface 190. In addition to the monitor, computers may also include other peripheral output devices such as speakers 197 and printer 196, which may be connected through an output peripheral interface 195. Of particular significance to the present invention, a microphone array 192, and/or a number of individual microphones (not shown) are included as input devices to the personal computer 110. The signals from the microphone array 192 (and/or individual microphones if any) are input into the computer 110 via an appropriate audio interface 194. This interface 194 is connected to the system bus 121, thereby allowing the signals to be routed to and stored in the RAM 132, or one of the other data storage devices associated with the computer 110.

The computer 110 may operate in a networked environment using logical connections to one or more remote computers, such as a remote computer 180. The remote computer 180 may be a personal computer, a server, a router, a network PC, a peer device or other common network node, and typically includes many or all of the elements described above relative to the computer 110, although only a memory storage device 181 has been illustrated in FIG. 1. The logical connections depicted in FIG. 1 include a local area network (LAN) 171 and a wide area network (WAN) 173, but may also include other networks. Such networking environments are commonplace in offices, enterprise-wide computer networks, intranets and the Internet.

When used in a LAN networking environment, the computer 110 is connected to the LAN 171 through a network interface or adapter 170. When used in a WAN networking environment, the computer 110 typically includes a modem 172 or other means for establishing communications over the WAN 173, such as the Internet. The modem 172, which may be internal or external, may be connected to the system bus 121 via the user input interface 160, or other appropriate mechanism. In a networked environment, program modules depicted relative to the computer 110, or portions thereof, may be stored in the remote memory storage device. By way of example, and not limitation, FIG. 1 illustrates remote application programs 185 as residing on memory device 181. It will be appreciated that the network connections shown are exemplary and other means of establishing a communications link between the computers may be used.

2.0 Self-Calibration

The exemplary operating environment having now been discussed, the remaining part of this description will be devoted to a description of the program modules embodying the invention. Generally, the system and process according to the present invention is not CPU use intensive and is capable of providing real-time microphone array self-calibration. It is based on a simplified channel model and a projection of sensor coordinates on a current direction of arrival (DOA) line, thus reducing the complexity of the calibration process and speeding up the calculations. Received energy levels are interpolated with line which is used to estimate the microphone gains. The following sections provide more specifics on the present system and process.

2.1 Channel Model and Assumptions

An audio sensor, such as those used in the previously described microphone array devices can be modeled by the following equation:

$$b(t)=h(t)*p(t) \tag{1}$$

where p(t) is the acoustic signal input into the audio sensor, b(t) is the signal generated by the sensor, and h(t) is the impulse response of the sensor. The impulse response is essentially dictated by the particular electronics used in the sensor such as its pre-amplifier and microphone can vary significantly between sensors.

To simplify the model of a microphone array sensor channel it is assumed that the amplitude-frequency characteristics of the sensors have the same shape in a work band associated with the human voice (i.e., approximately 100 Hz–8000 Hz). This is essentially true for microphones having a precision better than ±1 dB in the aforementioned working frequency band, which includes the majority of the electret-type microphones typically used in current microphone arrays. In addition, it is assumed that each microphone exhibits a slightly different sensitivity, as is usually the case. A typical sensitivity value would be 55 dB±4 dB where 0 dB is 1 Pa/V.

The foregoing assumptions allow the impulse response h(t) to be characterized by a simple gain. This significantly simplifies the conversion from acoustic signal p(t) to sensor signal $b_m(t)$ for the m-th channel, i.e., $$b_m(t)=G_m S_m A_m P(t-\Delta_m) \tag{2}$$

where $S_m$ is the microphone sensitivity, $A_m$ is the preamplifier gain, $G_m$ is a corrective gain and $\Delta_m$ is the delay, specific for this channel path. This relationship includes both the delay in propagation of the sound wave and the delay in the microphone-preamplifier electronics.

According to reference [4, pp 158–160], the differences in the phase-frequency characteristics of condenser microphones in the 200 Hz–200 Hz band are below 0.25 degrees, and thus can be ignored. The use of low tolerance resistors and capacitors in the preamplifiers (e.g., typically 0.1%) provides good matching as well. As a result, the problem is simplified from equalizing the channel impulse response between the microphones of the array to a simple process of computing a corrective gain for each microphone that makes the $G_m S_m A_m$ term substantially equal for each microphone. When this term is essentially equal for each microphone in the array, the array is considered as being calibrated. Establishing this set of corrective gains is then one goal of the present system and process.

It is further assumed that the sensor positions are known with sufficient precision to ignore any position mismatch issues, and that a DOA estimator is employed that provides results in terms of horizontal and elevation angles from the microphone array to the sound source (i.e., the DOA) when one sound source dominates (i.e., where there is only one sound source and no significant reverberation).

It is also assumed that the sound propagates as a flat wave, which is a reasonable assumption when the distance to the sound source is large as compared to the size of the microphone array. The validity of this last assumption will be demonstrated shortly.

2.2 Computing the Corrective Gains

Given the foregoing assumptions, the goal of the present self-calibration procedure is to find a set of corrective gains $G_m$ that provide the best channel matching by compensating for the differences in the channel parameters.

Consider an array of M microphones with given position vectors $\vec{p}$ and a centroid at the origin of the coordinate system. If a single sound source at position $c=(\phi, \theta, \rho)$ is assumed, where $\phi$ is the horizontal angle, $\theta$ is the elevation angle and $\rho$ is the distance, the sensors spatially sample the signal field at locations $P_m=(x_m,y_m,z_m)$:m=0,1, . . . ,M−1. This yields a set of signals that is denoted by the vector $\vec{b}(t, \vec{p})$ The received energy in a noiseless and reverberationless environment from each sensor is as follows:

$$E_m = \int |b_m(t, p_m)|^2 dt \approx \frac{P}{\|c - p_m\|^2}, \tag{3}$$

where $\|c-p_m\|$ denotes the Euclidian distance between the sound source and the corresponding sensor, and p is the sound source energy. In cases where ambient noise and reverberations are present, their energy can be added to each channel. For simplicity, environmental factors such as air density, and the like, which cause energy decay, are ignored. In applications such as calibrating a microphone array being used in a conference room, these environmental factors are usually negligible anyway.

As mentioned previously, it is assumed that a conventional DOA estimator is employed to perform sound source localization and provide the direction of arrival, i.e., the horizontal angle $\phi$ and the elevation angle $\theta$. Any conventional DOA estimation technique can be used to find the direction to the sound source. In tested versions of the present microphone array calibration system and process, a conventional beamsteering DOA estimation technique was employed, such as the one described in a co-pending U.S. Patent application entitled "A System & Process For Sound Source Localization Using Microphone Array Beamsteering", which was filed Jun. 16, 2003, and assigned Ser. No. 10/462,324. It is also noted that the DOA estimate is only used when it is also determined that one sound source (e.g., a speaker) is active and dominant over the noise and reverberation. This information is also obtained using any appropriate conventional method such as the one described in the aforementioned co-pending application. Eliminating all but the DOA estimates most likely to point to a single sound source minimizes the computation needed to maintain the calibration of the microphones and ensures a high degree of accuracy. In tested embodiments this meant the calibration procedure was implemented from 0.5 to 5 times per second and only when someone was talking. As such the present calibration process can be considered a real time process.

Figure 2:
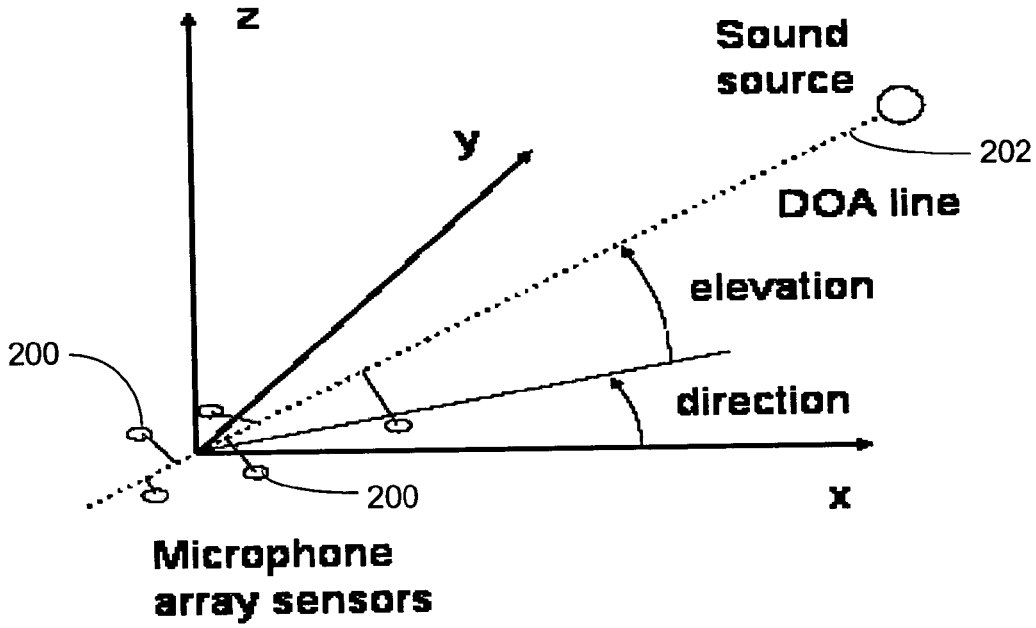
FIG. 2 is a diagram showing the projection of the locations of a group of array sensors onto the DOA line.

Given the sound source direction, the sensor coordinates 200 are projected onto the DOA line 202, as illustrated in FIG. 2. This changes the coordinate system from three dimensions to one dimension. In this coordinate system each sensor has position:

$$d_m=\rho_m \cos(\phi-\phi_m)\cos(\theta-\theta_m), \tag{4}$$

where $(\rho_m \phi_m \theta_m)$ are the sensor's coordinates in terms of a radial coordinate system with the centroid of the microphone array as its origin. Thus:

$$\rho_m = \sqrt{x_m^2 + y_m^2 + z_m^2}\ ,\ \varphi_m = \arctan\left(\frac{x_m}{y_m}\right),\ \theta_m = \arctan\left(\frac{z_m}{\sqrt{x_m^2 + y_m^2}}\right).$$

Figure 3:
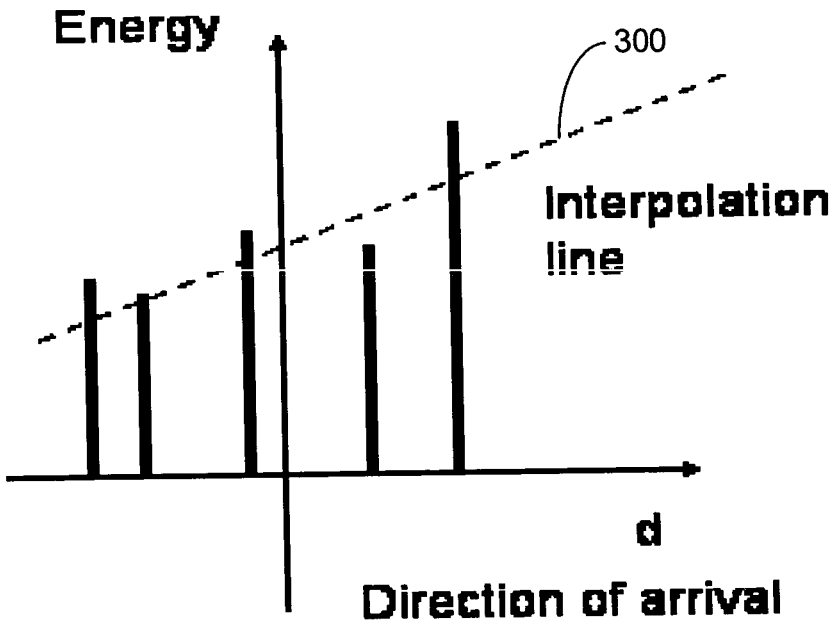
FIG. 3 is a graph plotting the measured energy of each frame of a frame set against the location of the sensor associated with the frame, as projected onto the DOA line.

A flat wave is assumed due to the absence of distance estimation from the array to the sound source. FIG. 3 is a graph showing an example of what the measured energies for each sensor of the microphone array might look like plotted for each of the locations of the sensors in terms of the new coordinate system. Theoretically, the energy would decrease in proportion to the square of the distance that the sensor is from the sound source. However, noise and reverberation skew this relationship. It is possible though to approximate the relationship between energy and distance using an appropriate approximation function, such as a parabolic or hyperbolic function, or any other function that tends to fit the data well. It is noted that in tested embodiments of the present system and process, a straight line function was employed with success. More, particularly, the relationship between energy and distance is approximated as a straight line 300 interpolated from the measured energy values for each sensor, as shown in FIG. 3. The new coordinate system allows the measured energy levels in each channel, which are defined as:

$$E_m = \frac{1}{N}\sum_{k=0}^{N-1} b_m(kT)^2, \tag{5}$$

where N is the number of samples taken from a captured audio frame and T is the sampling period, to be interpolated as with a straight line:

$$\tilde{E}(d)=a_1 d+a_0, \tag{6}$$

where $a_1$ and $a_0$ are such that they satisfy the Least Means Squares requirement:

$$\min\left(\sum_{i=0}^{M-1}\left(\tilde{E}(d_i) - E_i\right)^2\right). \tag{7}$$

In order to stabilize the calibration system and process, if the coefficient $a_1$ is computed to be less than zero, then it is set to zero and the other coefficient $a_0$ is set to be equal to the average energy of all the channels. This stabilization procedure is performed rather than just discarding the current frame set because when there are initially large differences in the microphone sensitivities this averaging will speed the gain convergence process that will be described shortly.

At this point the measured energy $E_m$ and the estimated energy $\tilde{E}(d_m)$ for each channel are available. If the assumption is made that any difference between a measured energy and the estimated energy computed using Eq. (6) is due to the characteristic parameters of the microphone, then a gain can be computed which will compensate for this difference. More particularly, the estimated gain $g_m$ is computed as:

$$g_m = G_m^{n-1}\sqrt{\frac{E_m}{\tilde{E}(d_m)}}\ , \tag{8}$$

where $G_m^{n-1}$ is the last gain computed for the channel under consideration (and where the initial values of $G_m^{n-1}$ is set equal to 1).

In order to keep the average gain of the microphone array close to 1, the gains of each channel can be normalized. To this end, the corrective gains computed via Eq. (8) can be normalized such that the sum of the gains computed for each sensor divided by the number of sensor equals 1, i.e., $$\frac{1}{M}\sum_{m=0}^{M-1} G_m^n = 1 \tag{9}$$

where M is the total number of sensors in the microphone array, $G_m^n$ is the normalized gain for the $m^{th}$ sensor for the audio frame n currently under consideration. The normalized gain $G_m^n$ for each sensor is computed by multiplying the gain computed for that sensor by a normalization coefficient. Namely, $$G_m^n = k g_m^n \tag{10}$$

where k is the normalization coefficient which is computed as:

$$k = \frac{1}{\frac{1}{M}\sum_{m=0}^{M-1} g_m^n}. \tag{11}$$

The present calibration system and process can be further stabilized by discarding the current frame set if the normalized gains are outside a prescribed range of acceptable gain values tailored to the manufacturing tolerances of the microphones used in the array. For example, in tested embodiments of the present invention, the computed gain for each channel of the array had to be within a range from 0.5 to 2.0. If not, the computed gains were discarded.

The normalized gains will still be susceptible to variation due to reverberation in the environment. One way to handle this is to average the effects of reverberation over time with the goal of minimizing its impact on the corrective gain. More particularly, the final sensor gain for each sensor for the audio frame under consideration is computed as:

$$G_m^n = (1-\alpha)G_m^{n-1} + \alpha G_m, \tag{12}$$

where $G_m^{n-1}$ is the gain computed for the $m^{th}$ sensor in the last frame to be considered, $G_m^n$ is the new normalized gain value the $m^{th}$ sensor, and $\alpha$ is adaptation parameter. The adaptive coefficient $\alpha$ is selected in view of the environment in which the present microphone array calibration system and process is operating. For example, it has been found that an adaptive coefficient $\alpha$ generally ranging between about 0.001 and 0.01 would be an appropriate choice. More particularly, in a controlled environment where reverberation is minimized, an adaptive coefficient near to 0.01 would be chosen. While the final sensor gain will still be heavily weighted to the gain computed for the last frame process a relatively greater portion is attributable to the newly computed gain in comparison to using a smaller coefficient value. In real world situations where reverberation can be a substantial influence, an adaptation coefficient nearer to 0.001 would be chosen, thereby giving an even greater weight to the previously computed gain value. Over time the gain value should stabilize as the reverberation influence, which may significantly affect a gain value computed for a particular audio frame, will cancel out, leaving a more accurate gain value. In tested embodiments operated in a controlled environment using an adaptation coefficient of approximately 0.01, and a frame rate (after eliminating frames not exhibiting a single dominate sound source) amounting to about 10 frames per second, the gain value converged after about 6 minutes. It will take longer for the gain to converge if a smaller adaptation coefficient is employed, but for real world applications the gain will exhibit less drift.

2.3 Error Analysis

In the projection of microphone coordinates on the DOA line it was assumed the sound propagated as a flat wave. The relative error in the estimated energy due to this flat wave assumption is given by:

$$\varepsilon_{FW} = 1 - \frac{1}{\sqrt{1 - \left(\frac{l_m}{2d_m}\right)}}, \tag{13}$$

where $\epsilon_{FW}$ is the relative error, $l_m$ is microphone array size and $d_m$ is the distance to the sound source. In tested embodiments of the present system and process, the microphone array had eight equidistant sensors arranged in a circular pattern with a diameter of 14 centimeters. Thus, the array had a size of 0.14 meters. In addition, the working distance to the speaker was typically between about 0.8 and 2.0 meters (e.g., a conference room environment). The relative error for this distance range is shown in Table 1. In addition, Table 1 shows the error caused by approximating the relationship between energy and distance as a straight line interpolated from the measured energy values for each sensor, as described above.

TABLE 1

| Distance to Sound Source (m) | 0.8 | 1.0 | 1.5 | 2.0 |
|---|---|---|---|---|
| Flatwave error (%) | 0.385 | 0.246 | 0.109 | 0.061 |
| Interpolation error % | 0.252 | 0.161 | 0.071 | 0.040 |

The errors introduced by the present self-calibration system and process are small in comparison to the overall calibration error. For example, a maximum of about only 0.6 percent is attributable to the present system and process at a distance to the sound source of 0.8 meters. In experiments with the present system and process it was found that the overall calibration error rate was about 5.0 percent. Thus, the error contributions from other factors, such as reverberation, the signal-to-noise ratio and DOA estimation error, are much higher. Namely, from the overall 5% relative error, to which calibration process converges, only 0.6% or less is due to the present system and process (at least for the sound source-to-microphone array distance range associated with Table 1).

In regards to the overall error of 5.0 percent it is noted that this resulted from the use of an adaptation coefficient of 0.01. It is believed that using a smaller coefficient (such as about 0.001) would result in the overall error decreasing to something on the order of 1.0 percent.

3.0 Implementation

The present self-calibration process is realized as separate thread, working in parallel with the main audio stream processing associated with a microphone array. One implementation of this self-calibration process will now be described.

Figure 4:
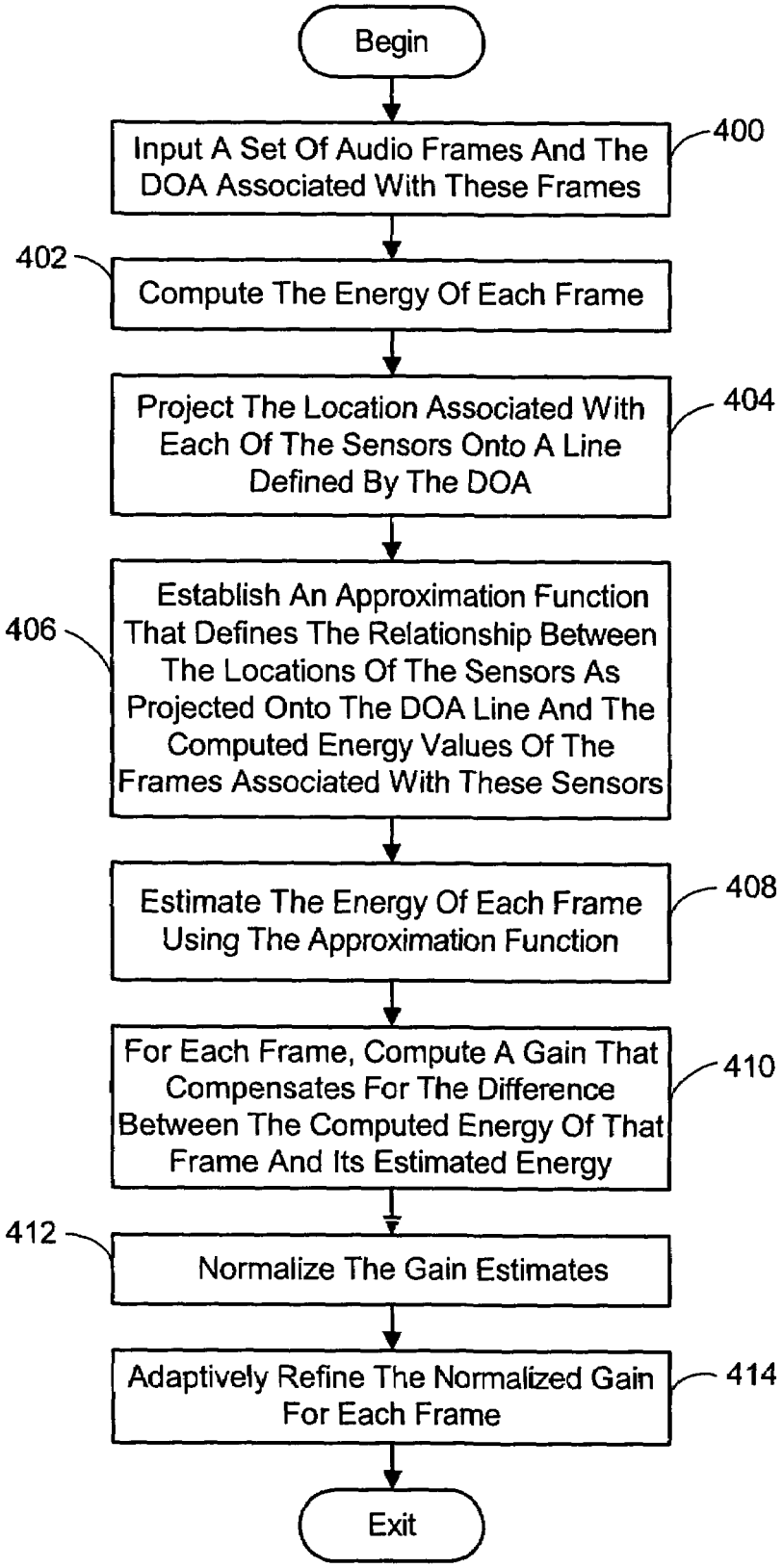
FIG. 4 is a flow chart diagramming one embodiment of a process for self calibrating a plurality of audio sensors of a microphone array, according to the present invention.

As stated previously, any conventional DOA estimator is used to provide an estimate of the direction of a sound source in terms of the horizontal and elevation angles from the microphone array to the sound source. This is done on a frame by frame basis (e.g., 23.22 ms frames represented by 1024 samples of the sensor signal that was sampled at a 44.1 kHz sampling rate), with any frame set that does not exhibit evidence of a single, dominant sound source being eliminated prior to or after computing the DOA. Thus, referring to FIG. 4, the present self-calibration process starts with inputting a substantially contemporaneous, non-eliminated audio frame for each channel (or at least two), as well as the DOA associated with these frames (process action 400). It is noted that computing the DOA of frames exhibiting a single dominant sound source is often a procedure that is required for the aforementioned main audio stream processing, such as when it is desired to ascertain the location of a speaker. In such cases, no additional processing would be needed to implement the present invention in this regard.

Whenever a set of audio frames and their associated DOA are input, the energy of each frame is computed (process action 402). In one embodiment, this is accomplished as described previously using Eq. (5) and the audio frame captured from that sensor. Next, the location associated with each of the sensors as projected onto a line defined by the DOA are established (process action 404). As described previously, this is accomplished by projecting the known location of these sensors in terms of a radial coordinate system with the centroid of the microphone array as its origin onto the DOA line (see Eq. (4)). An approximation function is then established that defines the relationship between the locations of the sensors as projected onto the DOA line and the computed energy values of the frames associated with these sensors (process action 406). In tested embodiments, a straight line function was employed as described above using Eqs. (6) and (7). Using the approximation function, an estimated energy is computed for each of the frames (process action 408). Next, for each frame, an estimated gain factor is computed that compensates for the difference between the computed energy of a sensor and its estimated energy (process action 410). This is accomplished using Eq. (8). The computed gain estimates are then normalized (process action 412) by essentially dividing each by the average of the gain estimates (see Eqs. (10) and (11)). The normalized gain of each frame can be adaptively refined to compensate for reverberation and other error causing factors (process action 414). This is accomplished via Eq. (12) and a prescribed adaptation parameter. Once the final gain factor for each frame has been computed it is applied to the next frame input which is associated with the same sensor of the microphone array, prior to the frame being processed.

It is noted that in the foregoing procedure, while every qualifying frame of audio data could be processed, this need not be the case. For example, a prescribed number per second limitation might be imposed. Further, as described previously, if the adaptation parameter scheme is implemented, the gain value for a channel of the microphone array will eventually stabilize. As such it may not change over a succession of iterations of the calibration process. Given this, it is optionally possible to configure the present self-calibration system and process to be suspended whenever the gain value for a channel (or alternately all the channels) has not changed (i.e., has not exceeded a prescribed change threshold) for a prescribed time period or over a prescribed number of calibration iterations. Still further, the present system and process could be configured to periodically "wake up" and compute the gain value for a suspended channel to ascertain if it has changed. If so, the self-calibration process is resumed.

4.0 References

[1] H. Van Trees. *Detection, Estimation and Modulation Theory, Part IV: Optimum array processing*. Wiley, N.Y.

[2] M. Feder and E. Weinstenin. "Parameter estimation of superimposed signals system using EM algorithm". IEEE Trans. Acoustic., Speech and Sig. Proc., vol. ASSP-36, 1988.

[3] G. S. K. Wong and T. F. W. Embleton (Eds.), *AIP Handbook of Condenser Microphones: Theory, Calibration, and Measurements*, American Institute of Physics, New York, 1995.

[4] S. Nordholm, I. Claesson, M. Dahl. "Adaptive Microphone Array Employing Calibration Signals. An Analytical Evaluation". IEEE Trans. on Speech and Audio Processing, December 1996.

[5] M. Seltzer, B. Raj. "Calibration of Microphone arrays for improved speech recognition". Mitsubishi Research Laboratories, TR-2002-43, December 2001.

[6] H. Wu, Y. Jia, Z. Bao. "Direction finding and array calibration based on maximal set of nonredundant cumulants". Proceedings of ICASSP '96.

[7] H. Teutsch, G. Elko. "An Adaptive Close-Talking Microphone Array". IEEE Workshop on Applications of Signal Processing to Audio and Acoustics, New York, 2001.

Wherefore, what is claimed is:

1. A computer-implemented process for self calibrating a plurality of audio sensors of a microphone array, wherein each sensor has a known location and generates a signal representing a channel of the array, said process comprising using a computer to perform the following process actions:

inputting a set of substantially contemporaneous audio frames extracted from the signals generated by at least two sensors of the array and a direction of arrival (DOA) associated with the frame set;

computing the energy of each frame;

establishing an approximation function that characterizes the relationship between the locations of the sensors and their computed energy values and using the function to estimate the energy of each frame; and for each frame, computing an estimated gain that compensates for the difference between the computed energy of the frame and its estimated energy, and applying the gain to the next frame associated with the same audio sensor.

2. The process of claim 1, wherein the process action of inputting the set of audio frames, comprises an action of inputting the audio frames and associated DOA only if the frames comprise audio data exhibiting evidence of a single dominant sound source.

3. The process of claim 1, wherein the process action of establishing the approximation function, comprises the actions of:

projecting the location of each sensor associated with an input frame onto a line defined by the DOA;

establishing the straight line function that characterizes the relationship between the projected locations of the sensors on the DOA line and the computed energy values of the frames associated with the sensors; and estimating the energy of each frame using the straight line function.

4. The process of claim 3, wherein the process action of projecting the location of each sensor associated with an input frame onto a line defined by the DOA, comprises an action of projecting the locations of the sensors, which are known in terms of a radial coordinate system with the centroid of the microphone array as its origin, onto the DOA line.

5. The process of claim 1, further comprising a process action of normalizing the computed gain estimates by dividing each by the average of all the gain estimates.

6. The process of claim 1, further comprising inputting a series of substantially contemporaneous audio frame sets extracted from the signals generated by at least two sensors of the array and a DOA associated with each frame set, wherein the audio frames are input only if they comprise audio data exhibiting evidence of a single dominant sound source, and repeating the process actions of claim 1 for each set of frames input.

7. The process of claim 6, wherein the number of sets of substantially contemporaneous audio frames input over a prescribed time period is limited to a prescribed number to reduce computational costs.

8. The process of claim 6, further comprising a process action of adaptively refining the gain each time a gain is computed, said refining action comprising:

establishing an adaptation parameter that dictates the weight a currently computed gain is given; and computing the refined gain as the sum of the gain multiplied by the adaptation parameter, and a refined gain computed for the immediately preceding frame input from of the same array channel as the frame used to compute the gain under consideration multiplied by one minus the adaptation parameter.

9. The process of claim 8, wherein the adaptation parameter is selected within a range of parameter values between about 0.001 and about 0.01.

10. The process of claim 9, wherein an adaptation parameter closer to 0.01 is chosen if calibrating a microphone array operated in a controlled environment wherein reverberations are minimal.

11. The process of claim 9, wherein an adaptation parameter closer to 0.001 is chosen if calibrating a microphone array operated in an environment wherein reverberations are not minimal.

12. The process of claim 8, further comprising the process actions of:

monitoring the value of each refined gain computed for a channel of the array;

determining if the difference between the values of a prescribed number of consecutively computed refined gains exceeds a prescribed change threshold;

whenever it is found that the change threshold is not exceeded, suspending the inputting of any further frames associated with the affected channel of the array.

13. The process of claim 12, further comprising, whenever the inputting of further frames has been suspended for an array channel, performing the process actions of:

periodically inputting at least one new audio frame extracted from the signal generated by the sensor of the array associated with the array channel under consideration, wherein the audio frame is input only if it comprises audio data exhibiting evidence of a single dominant sound source;

determining if the difference between the last, previously-computed refined gain for the channel and the current gain computed for the channel exceeds the prescribed change threshold; and whenever it is found that the change threshold is exceeded, reinitiating the inputting of further frame sets.

14. A system for self calibrating the audio sensors of a microphone array, comprising:

a microphone array having a plurality of audio sensors generating signals each of which represents a channel of the array;

a general purpose computing device;

a computer program comprising program modules executable by the computing device, wherein the computing device is directed by the program modules of the computer program to, input a set of substantially contemporaneous audio frames extracted from the signals generated by at least two sensors of the array, wherein the audio frames are input only if they comprise audio data exhibiting evidence of a single dominant sound source, input a direction of arrival (DOA) associated with inputted the frames, for each set of frames and associated DOA input, compute the energy of each frame, project a pre-established location of each sensor associated with an input frame onto a line defined by the DOA establish an approximation function that characterizes the relationship between the projected locations of the sensors on the DOA line and the computed energy values of the frames associated with the sensors, estimate the energy of each frame using the approximation function, for each frame, compute an estimated gain that compensates for the difference between the computed energy of the frame and its estimated energy, normalize the computed gain estimates by dividing each by the average of the gain estimates, and respectively apply each of the normalized gain estimates to the next frame associated with the same sensor.

15. The system of claim 14, wherein the program module for computing the energy of each frame, comprises a sub-module for computing $$E_m = \frac{1}{N}\sum_{k=0}^{N-1} b_m(kT)^2,$$

where $E_m$ is the computed energy of the frame of the $m^{th}$ sensor, N is the number of samples associated with the inputted audio frame under consideration, $b_m(kT)$ is the input sample from the m-th sensor at moment kT, and T is the sampling period used to generate the frames.

16. The system of claim 14, wherein the program module for projecting the pre-established location of each sensor associated with an input frame onto the line defined by the DOA, comprises a sub-module for projecting the locations of the sensors, which are known in terms of a radial coordinate system with the centroid of the microphone array as its origin, onto the DOA line.

17. The system of claim 14, wherein the program module for establishing an approximation function that characterizes the relationship between the projected locations of the sensors on the DOA line and the computed energy values associated with the sensors, comprises sub-modules for:

defining a straight line function as having the form $\tilde{E}(d)=a_1d+a_0$, wherein $\tilde{E}(d)$ is the estimated energy of a frame, d is the projected location of the sensor associated with the frame, and $a_1$ and $a_0$ unknown coefficients;

computing the values of $a_1$ and $a_0$ that produce estimated energy values for each projected sensor location that satisfy the Least Means Squares requirement such that $$\left(\sum_{i=0}^{M-1}\left(\tilde{E}(d_i)-E_i\right)^2\right)$$

is minimized where M is the number of sensors having an inputted frame associated therewith and E is the computed energy of a frame.

18. The system of claim 17, wherein the program module for establishing an approximation function further comprises sub-modules for, whenever the coefficient $a_1$ is computed to be less than zero:

setting the coefficient $a_1$ to zero; and setting the coefficient $a_0$ to the average of the computed energy values associated with the sensors.

19. The system of claim 17, wherein the program module for computing an estimated gain that compensates for the difference between the computed energy of the frame and its estimated energy, comprises a sub-module for computing $$g_m = G_m^{n-1}\sqrt{\frac{E_m}{\tilde{E}(d_m)}},$$

where $g_m$ is the estimated gain, and where $G_m^{n-1}$ is the last gain computed for the channel under consideration or 1 if the gain has not been computed before.

20. The system of claim 14, further comprising a program module for discarding the normalized gains computed the set of frames under consideration whenever the estimated gain of the current frame is outside a prescribed range of acceptable gain values.

21. The system of claim 20, wherein the prescribed range of acceptable gain values comprises gain values ranging from about 0.5 to about 2.0.

22. The system of claim 19, wherein the program module for respectively applying each of the normalized gain estimates to the frame associated with the same sensor, comprises a sub-module for multiplying the frame by the gain estimate associated with the array channel where the frame was extracted.

23. The system of claim 14, further comprising a program module for adaptively refining the normalized gain for each sensor, said refining module comprising sub-modules for:

establishing an adaptation parameter that dictates the weight a currently computed normalized gain is given;

computing the refined normalized gain as $G_m^n=(1-\alpha)G_m^{n-1}+\alpha G_m$, where $G_m^n$ is the refined normalized gain, $G_m^{n-1}$ is the last previously-computed refined normalized gain for the same array channel, and $\alpha$ is the adaptation parameter.

24. The system of claim 23, wherein the adaptation parameter is selected within a range of parameter values between about 0.001 and about 0.01, and wherein an adaptation parameter closer to 0.01 is chosen if calibrating a microphone array operated in a controlled environment wherein reverberations are minimal, and wherein an adaptation parameter closer to 0.001 is chosen if calibrating a microphone array operated in an environment wherein reverberations are not minimal.

25. The system of claim 23, further comprising program modules for:

monitoring the value of each refined normalized gain computed for a channel of the array;

determining if the difference between the values of consecutively computed refined normalized gains in any channel exceeds a prescribed change threshold within a prescribed period of time;

whenever it is found that the change threshold is not exceeded in any channel, suspending the inputting of any further frame sets.

26. The system of claim 25, further comprising program modules for, whenever the inputting of further frames sets has been suspended:

periodically inputting at least one new audio frame set, wherein the audio frame set is input only if the frames comprise audio data exhibiting evidence of a single dominant sound source;

computing normalized gain estimates for the set;

determining if the difference between the last, previously-computed refined normalized gain for any channel and the current normalized gain computed for channel the exceeds the prescribed change threshold; and whenever it is found that the change threshold is exceeded, reinitiating the inputting of further frame sets.

27. A computer-readable medium having computer-executable instructions for self calibrating a plurality of audio sensors of a microphone array, wherein each sensor has a known location and generates a signal representing a channel of the array, said computer-executable instructions comprising:

inputting a series of substantially contemporaneous audio frame sets extracted from the signals generated by at least two sensors of the array and a direction of arrival (DOA) associated with each frame set, wherein an audio frame set is input only if the frames thereof comprise audio data exhibiting evidence of a single dominant sound source;

for each frame set inputted, computing the energy of each frame, establishing an approximation function that characterizes the relationship between the locations of the sensors and their computed energy values and using the function to estimate the energy of each frame, and for each frame, computing an estimated gain that compensates for the difference between the computed energy of the frame and its estimated energy, and applying the gain to the frame.

28. The computer-readable medium of claim 27, wherein the instruction for establishing the approximation function, comprises sub-instructions for:

projecting the location of each sensor associated with an input frame onto a line defined by the DOA;

establishing a straight line function that characterizes the relationship between the projected locations of the sensors on the DOA line and the computed energy values of the frames associated with the sensors; and estimating the energy of each frame using the straight line function.

29. The computer-readable medium of claim 28, further comprising an instruction for normalizing the computed gain estimates by dividing each by the average of all the gain estimates.

30. The computer-readable medium of claim 29, further comprising an instruction for adaptively refining the normalized gain each time a gain is computed, said refining instruction comprising sub-instructions for:

establishing an adaptation parameter that dictates the weight a currently computed normalized gain is given; and computing the refined normalized gain as the sum of the normalized gain multiplied by the adaptation parameter, and a refined normalized gain computed for the immediately preceding frame input from of the same array channel as the frame used to compute the normalized gain under consideration multiplied by one minus the adaptation parameter.

31. The computer-readable medium of claim 30, wherein the sub-instruction for establishing an adaptation parameter, comprises selecting the adaptation parameter to be within a range of parameter values between about 0.001 and about 0.01, and wherein an adaptation parameter closer to 0.01 is chosen if calibrating a microphone array operated in a controlled environment wherein reverberations are minimal, and wherein an adaptation parameter closer to 0.001 is chosen if calibrating a microphone array operated in an environment wherein reverberations are not minimal.

* * * * *